US005753304A

United States Patent [19]

Tung

[11] Patent Number: 5,753,304

[45] Date of Patent: May 19, 1998

[54] ACTIVATION BATH FOR ELECTROLESS NICKEL PLATING

[75] Inventor: Weily Tung, Rochester, N.Y.

[73] Assignee: The Metal Arts Company, Inc., Geneva, N.Y.

[21] Appl. No.: 880,281

[22] Filed: Jun. 23, 1997

[51] Int. Cl.[6] ..... B05D 3/04; C23C 3/02

[52] U.S. Cl. ..... 427/304; 427/436; 427/438; 427/443.1; 106/1.05; 106/1.11

[58] Field of Search ..... 427/98, 304, 305, 427/435, 436, 437, 438, 443.1; 106/1.05, 1.11, 1.21, 1.22

[56] References Cited

U.S. PATENT DOCUMENTS 3,682,671 8/1972 Zeblisky ..... 106/1.05
3,992,211 11/1976 Skoll ..... 106/1.11
4,001,470 1/1977 Schulze-Berge ..... 106/1.11
4,328,266 5/1982 Feldstein ..... 427/305
4,483,711 11/1984 Harbulak et al. .
4,863,758 9/1989 Rhodenizer ..... 427/97

*Primary Examiner*—Shrive Beck
*Assistant Examiner*—Brian K. Talbot
*Attorney, Agent, or Firm*—Eugene Stephens & Associates

[57] ABSTRACT

In a process for the electroless plating of nickel onto a substrate made of aluminum or an aluminum alloy, an aqueous acidic solution containing as an essential component a palladium salt is used as an activator of the substrate prior to the nickel plating of the substrate. The activating solution contains a palladium salt, an alkali metal fluoride or hydrofluoric acid, a carboxylic acid complexing agent, an alkali metal salt of gluconic acid, an iron salt, a nickel salt, and deionized water.

27 Claims, No Drawings

ACTIVATION BATH FOR ELECTROLESS NICKEL PLATING

FIELD OF THE INVENTION

This invention relates to electroless nickel plating and to processes for preparing and products utilizing electroless nickel plating. More particularly, this invention relates to baths for the activation of substrates preparatory to the application of nickel by electroless plating.

BACKGROUND OF THE INVENTION

The electroless plating of nickel onto objects such as automobile wheels, computer disks, electrical conduits, pipes and fittings, and the like that are made of aluminum metal or aluminum alloys is widely practiced commercially. A typical and effective commercial operation may involve a series of steps that includes cleaning of the object to be plated, an acidic or caustic etch, dipping into nitric acid, activation or nucleation of the object, and then electroless nickel plating. Each step in the process is followed by a water rinse prior to the next step.

For the nickel plating of the aluminum or aluminum alloy to be commercially acceptable, a number of properties or characteristics of the plated object are important. For example, the adhesion of the nickel to the base or substrate must be excellent and blistering must be avoided. Uniformity of activation is important to obtain a smooth and uniform nickel plating minimizing any subsequent grinding. The activation of blind holes or threaded parts is essential so that these parts can be readily and satisfactorily plated. The nickel plating should demonstrate very little, if any, nodulation; and the activating solution that is used should be very carefully selected to avoid environmental contamination.

The selection of the solution components and composition to be used for activation of the aluminum substrate prior to nickel plating is very important in achieving the above properties of the product and the goals of the process.

The electroless plating industry generally employs the "zincate process" for the nickel plating of aluminum. In this commercial process, zinc is actually coated on the aluminum substrate during activation, and the zinc is then replaced by a nickel-phosphorus coating during the plating step.

The problems of the "zincate process" are well-known and they include:

1. The aluminum surface is etched by the high alkalinity solutions.
2. The zinc residue on the aluminum surface leads to low corrosion resistance.
3. The cyanide content of the activating bath is a health hazard.
4. The zinc contaminates the electroless nickel bath.
5. The chemistry is temperature dependent.
6. Twelve processing baths are typically required to precede the nickel bath.
7. The zincate process does not activate all types of aluminum-containing substrates, and especially does not effectively activate some of the aluminum-containing substrates that are now undergoing qualification testing to serve as hard disks in hard drives of computers.

SUMMARY OF THE INVENTION

This invention overcomes the deficiencies of the previously known techniques by providing an efficient, environmentally friendly process and activation bath for the preparation of electroless nickel plating of substrates, particularly substrates containing aluminum.

The invention contemplates a process for the electroless nickel plating of a substrate including the steps of cleaning the substrate, activating the substrate and applying nickel to the substrate in an electroless plating bath, employing an activation bath comprising from 0.1 to 2 grams of a palladium salt, from 2 to 250 grams of an alkali metal fluoride or hydrofluoric acid, from 0.05 to 0.5 liters of a carboxylic acid as a complexing agent, from 1 to 3 grams of an alkali metal salt of gluconic acid, from 1 to 5 grams of an iron salt, from 10 to 30 grams of a nickel salt, and sufficient deionized water to make one gallon.

The invention also contemplates nickel-plated substrates containing aluminum and having improved physical properties as a direct result of the process and the activation bath.

DESCRIPTION OF PREFERRED EMBODIMENTS

The activation bath in accordance with this invention includes from 0.1 to 2 grams of a palladium salt, from 20 to 250 grams of an alkali metal fluoride or hydrofluoric acid, from 0.05 to 0.5 liters of a carboxylic acid as a complexing agent, from 1 to 3 grams of an alkali metal salt of gluconic acid, from 1 to 5 grams of an iron salt, from 10 to 30 grams of a nickel salt, and sufficient deionized water to make one gallon.

Any suitable palladium salt may be used in the activation bath, such as palladium halides including palladium chlorides, bromides, fluorides, and iodides; potassium nitrate; and the like. Palladium dichloride is preferred. The palladium salt is preferably present in the bath in the amount of from 0.2 to 1.5 grams and most preferably in the amount of from 0.5 to 1 gram. While applicant does not wish to be bound by any theory as to the operation of the palladium salt in the activation bath, it is believed that the palladium present in the bath as palladium ion plates out onto the substrate in seed fashion and provides anchoring sites for the subsequent deposition of a tightly adhering nickel layer.

Hydrofluoric acid or any suitable alkali metal fluoride may be used in the activation bath, such as sodium fluoride or preferably potassium fluoride. The hydrofluoric acid or alkali metal salt is preferably present in the amount of 75 to 125 grams and most preferably in the amount of 90 to 110 grams. If hydrofluoric acid is used, it is preferably in the range of 1 to 11 ml of hydrofluoric acid per gallon, with about 5 ml of hydrofluoric acid per gallon being optimum. The fluoride is believed to function as a mild etch in the activation bath enhancing the seeding effect of the palladium metal.

Any suitable carboxylic acid may be used as a complexing agent, such as mono-functional carboxylic acids including glacial acetic acid, propionic acid, butyric acid, valeric acid, caproic acid, palmitic acid, stearic acid, and the like; or polyfunctional carboxylic acids including adipic acid, succinic acid, suberic acid, sebasic acid, oxalic acid, glutaric acid, pimelic acid, azelaic acid, phthalic acid, trimellic acid, and the like. By the term "acid", it is intended to include anhydrides and acid halides of the corresponding acid. The preferred acid is glacial acetic acid. The carboxylic acid is present in the activation bath preferably in the amount of 0.075 to 0.4 grams and most preferably in the amount of from 0.09 to 0.3 grams. The acid serves as a complexing agent, thus preventing the palladium from precipitating from the bath as PdO.

The alkali metal gluconate includes sodium gluconate and potassium gluconate preferably in the amount of from 1.4 to 2.6 grams and most preferably in the amount of from 1.8 to 2.2 grams. The presence of the gluconate is believed to aid in the control of the rate of deposition of the palladium metal to keep it in solution. The reasons for the beneficial effects of the gluconate are not clearly understood.

The iron and nickel salts are present to enhance the adhesion of nickel in the electroless plating step to the substrate and include halide and sulfate salts of each. Specific examples include ferrous chloride, ferrous bromide, ferrous sulfate, ferric chloride, ferric bromide, ferric sulfate, nickel chloride, nickel bromide, nickel sulfate, and the like. Ferric trichloride and nickel chloride and nickel sulfate are preferred. The iron salt is preferably present in the amount of from 2 to 4.5 grams and most preferably in the amount of from 3 to 4 grams. The nickel salt is preferably present in the amount of 15 to 27 grams and most preferably in the amount of from 19 to 25 grams.

Deionized water is used to make up one gallon of solution.

An alkali metal halide such as sodium chloride, sodium bromide, sodium fluoride, sodium iodide, or the corresponding potassium compounds can be added to the bath as an optional ingredient to facilitate the palladium salt going into solution. This ingredient is employed in an amount of from 0 to 85 grams, preferably from 30 to 80 grams, and most preferably from 50 to 75 grams.

While all of the ingredients can be mixed together simultaneously to achieve a satisfactory activation bath, it is preferred that the ingredients be added in an orderly sequence of steps and in the quantities indicated in accordance with the following Preparation I:

1. Mix 0.7 grams of palladium dichloride with 0.3 gallons of deionized water and allow to sit to form solution.
2. Mix 100 grams of potassium fluoride powder and 65 grams of sodium chloride powder.
3. Mix thoroughly 0.11 liters of glacial acetic acid and add to 0.3 gallons of deionized water.
4. Add the mixture of step 2 to that of step 3 and mix thoroughly.
5. Mix thoroughly 2 grams of sodium gluconate to the mixture of step 4.
6. Add the mixture of step 1 to that of step 5 and mix thoroughly.
7. Mix thoroughly 3.5 grams of ferric trichloride and 22.5 grams of nickel sulfate to the mixture of step 6.
8. Add sufficient deionized water to make one gallon.

While the activation bath in accordance with this invention can be used with many types of substrates, including plastics; ceramics; and metals, such as stainless steel, iron, nickel, chromium, and alloys and composites thereof, the inventive activation bath is especially suitable for the activation of aluminum substrates of all kinds. Thus, when the term "aluminum substrate" is used in this application, it is intended that it include, in addition to aluminum metal per se, all types of aluminum-containing materials including, but not limited to, aluminum alloys; aluminum composites; ceramics containing aluminum; aluminum carbides, such as aluminum carbide, aluminum-silicon-carbide, aluminum-boron-carbide; and the like. By "composites" is meant materials made up of two or more ingredients each of which is recognizable and unchanged in its basic character. A material suitable as a substrate for use in the manufacture of hard disks for the computer industry is described in U.S. Pat. No. 5,486,223, issued Jan. 1, 1996, to Robin A. Carden and assigned to Alyn Corp. When materials such as this have been activated by the zincate process explained above, the result has been incomplete activation leading to uneven and skip plating and severe pitting of the substrate, making the materials unusable for their intended purpose.

It is a significant feature of this invention that the activating solution is much more environmentally friendly than the activating solution used in the "zincating process", and the properties of the nickel-plated objects are superior to those made by "zincating".

A preferred and highly effective process for electroless nickel plating of aluminum objects includes the following steps, with each step being followed by a water rinse:

a. Cleaning the object to be plated with a standard aluminum cleaning bath for 8 minutes at 135° F.;
b. Etching for 30 seconds to 10 minutes at 140° F. with either sodium hydroxide (60 grams per liter) or concentrated phosphoric acid (4–20% by volume) plus sulfuric acid (6–20% by volume);
c. Activation for 20 to 100 seconds at room temperature with the activation bath (Preparation I) set forth above; and
d. Electroless nickel plating for 30 to 120 minutes at 180–185° F. using a solution containing Preparation II:

| | |
|---|---|
| Nickel sulfate hexahydrate | 30 grams/liter |
| Sodium hypophosphite | 30 grams/liter |
| Malic acid | 50 grams/liter |
| Citric acid | 15 grams/liter |
| Lead acetate | 0.80 grams/liter |
| Ethylenediaminetetraacetic acid | 0.50 grams/liter |

When aluminum substrates are plated with nickel in accordance with this invention, palladium is deposited on the substrate surface during the activation step. This produces a huge number of catalytically active regions of the substrate that facilitate the later bonding of the plated nickel to substrate. The plated product resulting from the electroless plating process then contains palladium dispersed between the nickel outer layer and the aluminum-containing substrate.

With some aluminum-containing substrates, an activation bath according to the invention has been found to produce superior nickel-plating results by omitting the etching step described above. Such an etching step typically precedes an activation bath in the above-described zincate process as well. There is also reasons to believe that adjustment of the substrate cleaning step explained above may allow an etching step to be eliminated for many other substrates to be activated by the bath of this invention. Eliminating an etching step significantly lowers the process cost by eliminating an etching bath and a following rinse. This also contrasts the inventive process favorably with the above-described zincate process, which typically involves 12 steps preceding the nickel plating, with each of the steps requiring a separate bath. These steps include:

1. an alkaline soap as a cleaning step
2. rinse
3. acid etch
4. rinse
5. a first zincating bath
6. rinse
7. nitric acid
8. rinse 9. a second zincate bath
10. rinse
11. nitric acid
12. rinse
13. nickel bath A preferred process according to the invention of this application is much simpler, even when it includes an etching step, which is preferably eliminated for many aluminum-containing substrates, resulting in the following:

1. substrate cleaner
2. rinse
3. activation bath
4. rinse
5. nickel bath

The following illustrative examples represent preferred embodiments of the invention. In these examples, the detailed process including steps a. through d. are employed, and the subsequent electroless nickel plating bath has the composition described above as Preparation II. Those skilled in this art will understand that the conditions used in the following examples can be varied, depending upon the objects to be plated and the physical properties desired to obtain the optimum effects. The compositions of the aluminum alloys are expressed here in weight percentages.

EXAMPLE 1

Computer disks made of an aluminum alloy containing 0.45% silicon, 0.10% copper, 0.10% manganese, 2.2–2.8% magnesium, 0.15–0.35% chromium, and 0.10% zinc are cleaned, etched, and activated, prior to being plated with nickel, using Preparation I as described above. The time for etching step b. is 30 seconds and the activation time 1 minute. The plated discs have excellent brightness, uniformity, and adhesion.

EXAMPLE 2

The procedure of Example 1 is repeated except that the substrates are computer disks containing respectively 85% aluminum and 15% boron carbide; 75% aluminum and 25% boron carbide; and 60% aluminum and 40% boron carbide. The finished disks have the same outstanding qualities as the disk of Example 1.

EXAMPLE 3

The procedure of Example 1 is repeated with substrates formed as computer disks containing respectively 75% aluminum and 25% silicon carbide, and 60% aluminum and 40% silicon carbide. The finished disks have the same outstanding qualities as the disk of Example 1.

EXAMPLE 4

The procedure of Example 1 is repeated with substrates formed as computer disks containing respectively 75% aluminum and 25% silicon carbide, and 60% aluminum and 40% silicon carbide except that the etching step of Example 1 is omitted. The finished disks equal and exceed the outstanding qualities of the disk of Example 1.

EXAMPLE 5

Automobile wheels made of an aluminum alloy containing 0.92% silicon, 0.12% iron, 0.001% copper, 0.24% manganese, 0.31% magnesium, 0.05% zinc, and 0.14% titanium are treated following the procedure of Example 1. The etching time is 8 minutes and the activating time 1 minute. The platings have excellent brightness, uniformity, adhesion, and superior corrosion resistance.

EXAMPLE 6

Electrical conduit pipes and fittings made of an aluminum alloy containing 0.4–0.8% silicon, 0.7% iron, 0.15–0.4% copper, 0.15% manganese, 0.8–1.2% magnesium, 0.04–0.3% chromium, 0.25% zinc, and 0.15% titanium are treated as in Example 1. The etching time is 8 minutes and the activating time 30 seconds. The nickel platings have excellent brightness, uniformity, and adhesion; and the plating fill-in of the pipe threads and other areas that are difficult to plate is excellent.

Improper or incomplete wetting of the aluminum substrate surface during activation can lead to non-uniformities or point defects in the plating surface after electroless nickel plating. While the processes heretofore described normally give platings of very good surface physical quality, these non-uniform defects occasionally occur. The probability of obtaining these defects can be greatly reduced by the addition of a surfactant or a wetting agent to the activating solution. Such commonly used classes of materials include alkyl and aralkyl sulfonates; alkyl and aralkyl poly(alkoxy) alcohols; quaternary alkyl and aralkyl ammonium salts; and alkoxyalkyl, hydroxyalkyl, and aminoalkyl silanes. For example, the addition of 5 to 20 grams/gallon of N-beta-(aminoethyl)-gamma-aminopropyltrimethoxysilane reduces these defects significantly when added to an aqueous activation bath.

What is claimed is:

1. An activation bath comprising from 0.1 to 2 grams of a palladium salt, from 20 to 250 grams of an alkali metal fluoride or hydrofluoric acid, from 0.05 to 0.5 liters of a carboxylic acid as a complexing agent, from 1 to 3 grams of an alkali metal salt of gluconic acid, from 1 to 5 grams of an iron salt, from 10 to 30 grams of a nickel salt, and sufficient deionized water to make one gallon.

2. The activation bath of claim 1 further comprises from 30 to 80 grams of an alkali metal halide.

3. The activation bath of claim 1 wherein the palladium salt is a halide or nitrate.

4. The activation bath of claim 1 wherein the palladium salt is palladium dichloride.

5. The activation bath of claim 1 wherein the palladium salt is present in the amount of from 0.2 to 1.5 grams.

6. The activation bath of claim 1 wherein the palladium salt is present in the amount of from 0.5 to 1 gram.

7. The activation bath of claim 1 wherein the alkali metal fluoride is potassium fluoride.

8. The activation bath of claim 7 wherein the potassium fluoride is present in the amount of from 75 to 125 grams.

9. The activation bath of claim 7 wherein the potassium fluoride is present in the amount of from 90 to 110 grams.

10. The activation bath of claim 1 wherein the carboxylic acid is glacial acetic acid.

11. The activation bath of claim 10 wherein the glacial acetic acid is present in the amount of from 0.075 to 0.4 liters.

12. The activation bath of claim 10 wherein the glacial acetic acid is present in the amount of from 0.09 to 0.3 liters.

13. The activation bath of claim 1 wherein the alkali metal salt of gluconic acid is sodium gluconate.

14. The activation bath of claim 13 wherein the sodium gluconate is present in the amount of from 1.4 to 2.6 grams.

15. The activation bath of claim 13 wherein the sodium gluconate is present in the amount of from 1.8 to 2.2 grams.

16. The activation bath of claim 1 wherein the iron salt is ferric trichloride.

17. The activation bath of claim 16 wherein the ferric trichloride is present in the amount of from 2 to 4.5 grams.

18. The activation bath of claim 16 wherein the ferric trichloride is present in the amount of from 3 to 4 grams.

19. The activation bath of claim 1 wherein the nickel salt is nickel chloride or nickel sulfate.

20. The activation bath of claim 19 wherein the nickel salt is present in the amount of from 15 to 27 grams.

21. The activation bath of claim 19 wherein the nickel salt is present in the amount of from 19 to 25 grams.

22. The activation bath of claim 1 wherein the palladium salt is palladium dichloride in the amount of from 0.5 to 1 gram, the alkali metal fluoride is potassium fluoride present in the amount of from 90 to 110 grams, the carboxylic acid is glacial acetic acid present in the amount of from 0.09 to 0.3 liters, the alkali metal salt of gluconic acid is sodium gluconate present in the amount of from 1.8 to 2.2 grams, the iron salt is ferric trichloride present in the amount of from 3 to 4 grams, and the nickel salt is nickel chloride or nickel sulfate present in the amount of from 19 to 25 grams.

23. The activation bath of claim 2 wherein the alkali metal halide is sodium chloride.

24. The activation bath of claim 23 wherein sodium chloride is present in the amount of from 50 to 75 grams.

25. In a process for the electroless nickel plating of a substrate including the steps of cleaning the substrate, activating the substrate, and applying nickel to the substrate in an electroless plating bath, the improvement which comprises employing in the activating step an activation bath comprising from 0.1 to 2 grams of a palladium salt, from 20 to 250 grams of an alkaline metal fluoride or hydrofluoric acid, from 0.05 to 0.5 liters of a carboxylic acid as a complexing agent, from 1 to 3 grams of an alkali metal salt of gluconic acid, from 1 to 5 grams of an iron salt, from 10 to 30 grams of a nickel salt, and sufficient deionized water to make one gallon.

26. The process of claim 25 wherein the activating step follows the cleaning step without any intervening step of etching the substrate.

27. An aluminum-containing substrate plated with nickel by the process of claim 25.

* * * * *

UNITED STATES PATENT AND TRADEMARK OFFICE

CERTIFICATE OF CORRECTION

PATENT NO. : 5,753,304

DATED : May 19, 1998

INVENTOR(S) : Weily Tung

It is certified that error appears in the above-identified patent and that said Letters Patent is hereby corrected as shown below:

Claim 25, line 7, delete "alkaline" and insert --alkali--.

Signed and Sealed this

Sixth Day of October, 1998

*Attest:*

*Attesting Officer*

BRUCE LEHMAN

*Commissioner of Patents and Trademarks*